United States Patent [19]

Tack et al.

[11] 4,097,078

[45] Jun. 27, 1978

[54] DOOR LOCK FOR AUTOMOTIVE VEHICLE

[75] Inventors: Albert Tack; Friedrich Gabel, both of Wuppertal, Germany

[73] Assignee: Firma Tack & Gabel, Wuppertal, Germany

[21] Appl. No.: 665,261

[22] Filed: Mar. 9, 1976

Related U.S. Application Data

[63] Continuation-in-part of Ser. No. 514,894, Oct. 15, 1974, Pat. No. 3,997,202, which is a continuation of Ser. No. 330,488, Feb. 8, 1973, abandoned.

[30] Foreign Application Priority Data

Feb. 8, 1972 Germany ..... 72046130[U]

[51] Int. Cl.[2] ..... E05C 3/26

[52] U.S. Cl. ..... 292/216; 292/198

[58] Field of Search ..... 292/280, 216, DIG. 23, 292/DIG. 24, DIG. 25

[56] References Cited

U.S. PATENT DOCUMENTS

| | | | |
|---|---|---|---|
| 3,331,624 | 7/1967 | Pugh | 292/216 |
| 3,432,198 | 3/1969 | Connor | 292/DIG. 41 |
| 3,876,238 | 4/1975 | Watermann | 292/216 |

*Primary Examiner*—Richard E. Moore

*Attorney, Agent, or Firm*—Montague & Ross

[57] ABSTRACT

A door-lock assembly for an automotive vehicle comprises a key member on a post of the vehicular frame which upon closure of the door slides into a keyway of a keeper on the outer door surface, this key member coacting directly or through the intermediary of a locking fork with a swingable catch controlled by a latch mechanism within the door. A lock housing, containing the latch mechanism, is separated from the keeper by a door panel, the lock housing and the keeper being interconnected by screws passing through the panel. Within the keeper at least one of the screws is surrounded by a stationary sleeve forming the pivot for the catch; the locking fork, if provided, is pivoted on another such sleeve.

7 Claims, 9 Drawing Figures

FIG. 3
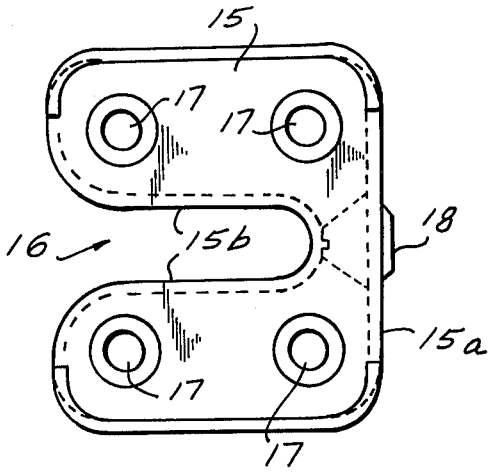
FIG. 4
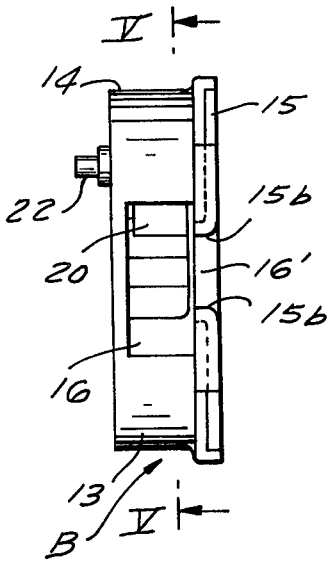
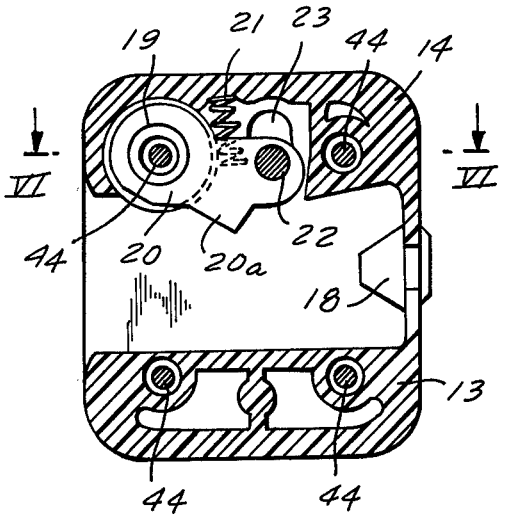
FIG. 5
FIG. 6
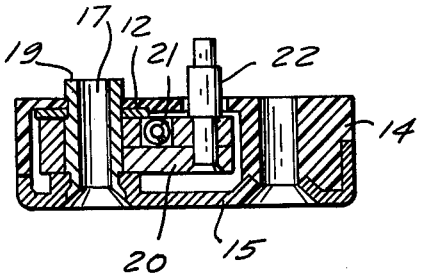

DOOR LOCK FOR AUTOMOTIVE VEHICLE

CROSS-REFERENCE TO RELATED APPLICATIONS

This application is a continuation-in-part of our copending application Ser. No. 514,894, now U.S. Pat. No. 3,997,202, filed Oct. 15, 1974 as a continuation of our prior application Ser. No. 330,488 which was filed Feb. 8, 1973 and is now abandoned.

FIELD OF THE INVENTION

Our present invention relates to a door-lock assembly, installed in an automotive vehicle, which includes a locking wedge or some other type of key member on a beam or post forming part of the vehicular frame and a keeper on a door surface confronting that post, the keeper having a channel or keyway receiving the key member upon closure of the door.

BACKGROUND OF THE INVENTION

It is known, e.g. from U.S. Pat. No. 3,281,176, to provide such a keeper with a swingable detent engageable with the key member, the detent being fulcrumed on a pin extending between a door panel and an outer wall of the keeper formed with the keyway. That wall is secured to the panel in such a way as to provide the necessary clearance for the swing of the detent, generally at points well separated from its pivotal axis. Such a structure occupies considerable space within the joint formed by the panel and the confronting post.

OBJECTS OF THE INVENTION

An important object of our invention, therefore, is to provide an improved door-lock assembly of the general type referred to which is more compact than these known constructions.

A related object is to provide an assembly of this character which is less likely than conventional structures to lead to a jamming of the door lock in the event of an accident.

SUMMARY OF THE INVENTION

We realize these objects, in accordance with the present invention, by spacedly securing the keyway-forming outer wall of the keeper to the post-confronting door surface with the aid of a plurality of parallel fastening elements such as screws or rivets traversing the intervening space, one of these fastening elements extending along the pivotal axis of a swingable catch forming part of a detent mechanism engageable with the associated key member. The catch may be fulcrumed on that fastening element through the intermediary of a sleeve which surrounds the fastener and spans two parallel walls of the keeper, i.e., the aforementioned outer wall and an inner wall adjoining the supporting door surface.

The assembly also includes the usual control means for alternately locking and releasing the catch. As described in our prior applications and patent indentified above, the control means may comprise a mechanism disposed in a lock housing within the door itself, being thus separated from the keeper by a door panel which has an aperture for a catch extension engageable by the control means. It should be understood, however, that our invention in its broader aspects is not limited to a construction in which the keeper and its locking mechanism are thus separated.

The catch may directly engage the key member, with the aid of suitable serrations on that member, or may coact with a locking fork co-operating with the key member upon its insertion into the keyway. In the latter case, advantageously, the locking fork is also fulcrumed on one of the fastening elements.

By making the fulcrum of the catch — and, possibly, also that of the locking fork — coincide with a fastener, we realize not only a considerable saving in space but also a more dependable construction since the sleeve surrounding the fastener, in the case of an accident involving deformation of the door joint, tends to maintain the requisite separation between the door surface and the outer keeper wall so as to prevent jamming of the detent mechanism.

As disclosed in our prior applications and patent, the key member may be provided with play-equalizing means for compensating any level difference that may exist between that member and the keyway of the keeper.

BRIEF DESCRIPTION OF THE DRAWING

These and other features of our invention will now be described in greater detail with reference to the accompanying drawing in which:

FIG. 3 is an elevational view of the keeper;

FIG. 4 is an end view of the keeper showing the insertion end of a pocket accommodating the key member;

FIG. 5 is a sectional view taken on the line V — V of FIG. 4;

FIG. 6 is a further sectional view taken on the line VI — VI of FIG. 5;

SPECIFIC DESCRIPTION

Figure 1:
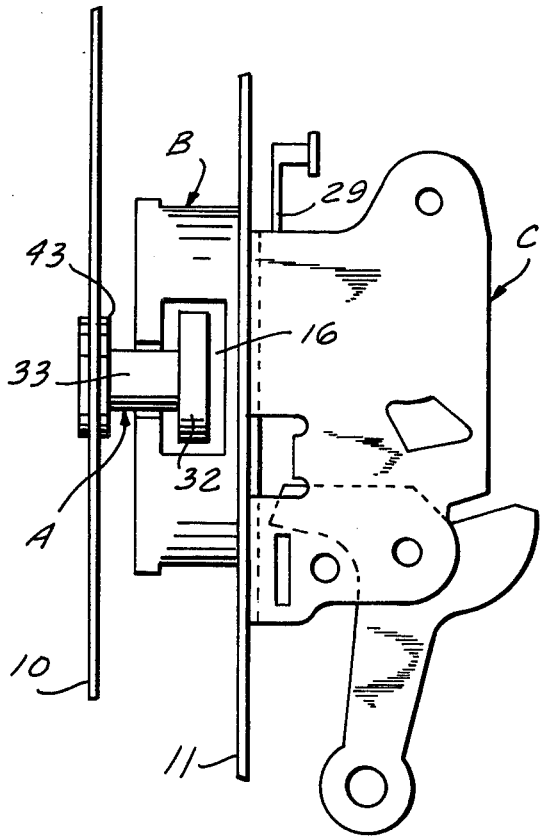
FIG. 1 is a schematic elevation of a door-lock assembly in accordance with the present invention, showing a key member inserted into an associated keeper.

The lock assembly shown in FIG. 1 comprises a key member A secured to a sheet-metal facing 10 on a door post of a vehicle whose door carries a keeper B on the outside and a lock housing C on the inside of a panel 11. The keeper B (see FIGS. 3 - 8) has a body of synthetic material with a solid sidewall 12 and lower and upper cheeks 13 and 14 spaced apart from each other, the opposite side of this body being partly closed by a cover 15 having a horizontal keyway 16' giving access to a pocket 16 between cheeks 13 and 14. Fastening screws 44 (see FIGS. 5 and 8), traversing the panel 11, can be inserted through mounting bores 17 for securing the keeper B to the lock housing C and thereby to the door itself. At one end of pocket 16 the cover 15 is bent over to form a support **15*a* (FIG. 3) for an abutment 18**.

Upper cheek 14 accommodates a pivotable catch 20 which is fulcrumed on a sleeve 19 and is biased by a spring 21 in a locking direction; sleeve 19 surrounds one of the fastening screws 44 which is therefore centered on the pivotal axis of the catch. At its end remote from the sleeve 19, the catch 20 carries a linking pin 22 which passes through a slot 23 of the base plate 12 and also through a similar slot 24 in the lock housing C (see FIG. 2). Naturally, the intervening panel 11 is suitably apertured to give passage to pin 22.

Figure 2:
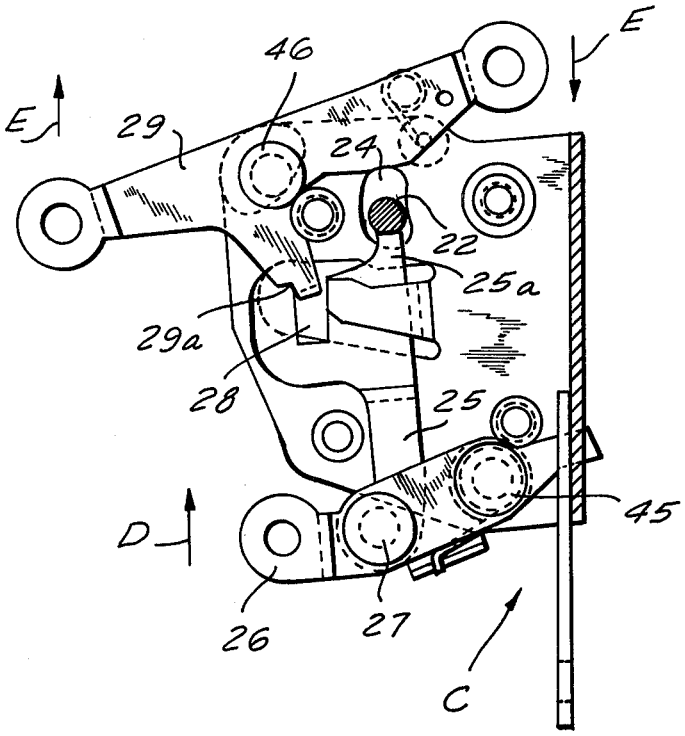
FIG. 2 is a rear view of a latch mechanism, forming part of the assembly of FIG. 1, shown in unlocked position.
Figure 7:
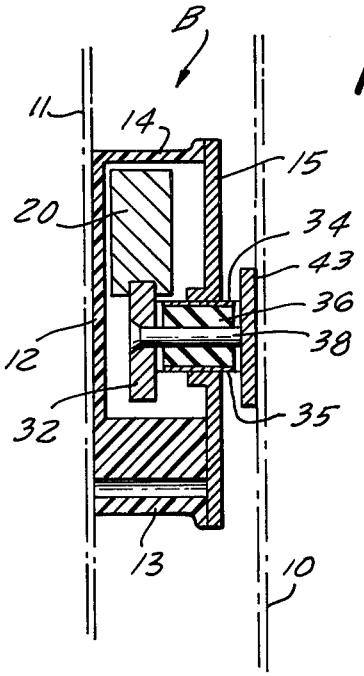
FIG. 7 is a vertical sectional view of the keeper with the key member inserted therein.

In the lock housing C the pin 22 co-operates with a detent 25 which is pivoted at 27 to a release lever 26 the latter being articulated to the housing at 45. The other end of the detent 25 is formed with a slot 28 to receive a projection **29*a* of a locking lever 29 with a fulcrum at 46. With pin 22 abutting a lug 25*a* of detent 25, as shown in FIG. 2, a clockwise swing of the release lever 26 (arrow D) entrains the catch 20** in an unlocking sense (counterclockwise in FIG. 5).

The locked state of the assembly is brought about by a clockwise swing of lever 29 about its pivot 46 as indicated by arrows E. The detent 25 then swings counterclockwise about its pivot point 27 so that the lug **25*a* is disaligned from pin 22. In case of an attempt to operate the release lever 26 under these circumstances, lug 25*a* simply moves past the pin 22**.

The key member A is divided into three parts, namely a central body 33 of plastic material and two lateral plates 32, 43 (here shown to be of metal) flanking that body. Plate 43 is attached to the door post at its facing 10 and remains outside the keeper B whereas plate 32 enters the pocket 16 thereof. The latter plate has a smooth lower edge **32*a* (FIG. 8), sliding along cheek 13, and an upper edge formed with indentations which are engageable by a tooth 20*a* of catch 20 upon an incomplete or full closure of the door as is well known per se. Body 33, which is of lesser height than the flanking plates 32 and 43, fits into the keyway 16' of keeper B between parallel edges 15*b* of its cover 15**, this cover constituting an exposed sidewall of the keeper confronting the door post.

Figure 8:
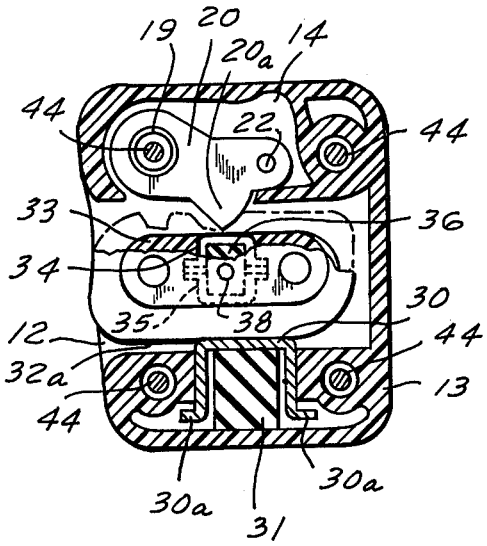
FIG. 8 is a sectional view similar to that of FIG. 5, showing the keeper equipped with resilient play-equilization means.

In the modified keeper as shown in FIG. 8, lower cheek 13 is centrally recessed to accommodate an elastic buffer 31 overlain by a metallic yoke 30 whose lower ends have lugs **30*a* holding it in position within that recess. Yoke 30 projects slightly above the upper surface of cheek 13 to bear upon the lower edge 32*a* of plate 32 for more positive guidance thereof in pocket 16**.

The plastic body 33 of keeper B has a central cutout receiving an elastic buffer 36 which is bracketed between an upper and a lower metallic yoke 34, 35 generally similar to yoke 30 of FIG. 8. Lugs on the confronting ends of the legs of these yokes serve to retain them in the cutout. Through the intermediary of the two yokes, buffer 36 bears resiliently upon the edges **15*b* (FIGS. 3 and 4) of cover 15 which bound the keyway 16', thereby equalizing whatever vertical play exists between these channel edges and the body 33. Buffer 36 is traversed by a horizontal bolt 38 interconnecting the plates 32 and 43**.

Figure 9:
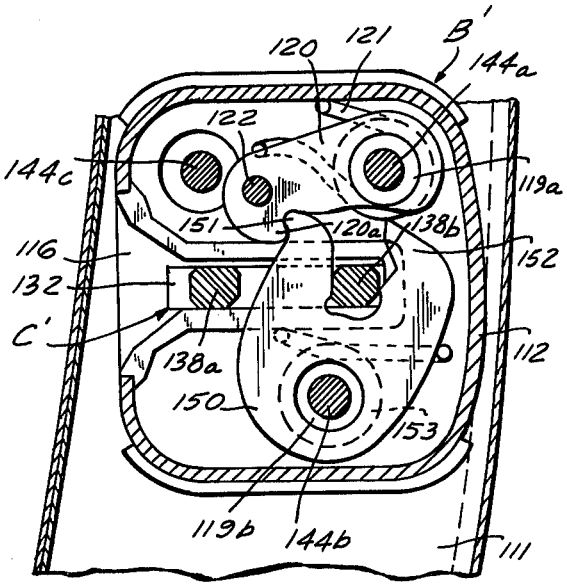
FIG. 9 is a view generally similar to FIG. 8, illustrating a modified assembly.

In FIG. 9 we have shown a modified keeper B' coacting with a key member C' which comprises a plate 132, receivable in its pocket 116, and two transverse bars **138*a*, 138*b* by which that plate is secured to the door post, the bars passing through the keyway (not shown) of keeper B' in the illustrated closure position. The keeper housing 112 is secured to the door panel 111 by three screws 144*a*, 144*b*, 144*c*, screws 144*a* and 144*b* being surrounded by respective sleeves 119*a*, 119*b* spanning the inner and outer housing walls. Sleeve 119*a* forms the pivotal axle of a catch 120 linked by a pin 122 with the associated locking mechanism located beyond panel 111, this catch being biased counterclockwise by a spring 121. A locking fork 150, with two prongs 151 and 152, is pivoted on the sleeve 119*b* and is also biased counterclockwise by a spring 153**.

As long as the key member C' is withdrawn from the keeper B', fork 150 is swung counterclockwise through about 60° from its illustrated position, against a stop not shown, whereby its prongs 151, 152 form an inlet for the bar **138*b*; hook 120*a* of catch 120 then rides on the back of prong 152. Upon incipient door closure, bar 138*b* enters between the prongs 151, 152 to swing the fork 150 clockwise against the force of its spring 153, the hook 120*a* engaging first the prong 152 and then, upon complete closure, the prong 151. To release the fork 150 and with it the key member C', catch 120 is swung clockwise against the force of spring 121 by an upward displacement of its linking pin 122** via the locking mechanism as described above.

We claim:

1. A door-lock assembly for an automotive vehicle provided with a post on the vehicular frame and a door having a panel with a post-confronting surface, comprising:

a key member fixedly mounted on said post;

a keeper on said post-confronting surface of said panel at the level of said key member, said keeper having an outer wall spaced from said surface and formed with a keyway receiving said key member upon closure of the door;

a plurality of fastening elements securing said keeper to the door, said fastening elements penetrating said panel and traversing the space between said wall and said surface;

detent means in said space engageable with said key member, said detent means including a swingable catch fulcrumed on one of said fastening elements; and control means secured to said door for alternately locking and releasing said catch.

2. A door-lock assembly as defined in claim 1 wherein said control means is separated from said keeper by said panel, said catch being provided with an extension passing through an aperture in said panel for engagement by said control means.

3. A door-lock assembly as defined in claim 2 wherein said keeper is provided with an inner wall adjoining said surface and having a slot traversed by said extension, said slot registering with said aperture, and at least one transverse sleeve spanning said outer and inner walls, said one of said fastening elements passing through said sleeve, said catch being pivoted on said sleeve.

4. A door-lock assembly as defined in claim 2 wherein said control means comprises a lock housing in contact with said panel traversed by said fastening elements and secured thereby to the door.

5. A door-lock assembly as defined in claim 2 wherein said detent means further comprises a locking fork engageable with said key member and pivoted on another of said fastening elements, said catch coacting with said fork for retaining said key member in said keyway.

6. A door-lock assembly as defined in claim 3 wherein said fastening elements are screws.

7. A door-lock assembly as defined in claim 1 wherein said key member is provided with an elastically deformable part, said outer wall being provided with parallel upper and lower edges bounding said keyway and engaging said deformable part upon closure of the door for compensating level differences between said key member and said keyway.

* * * * *